United States Patent [19]

Gaudino

[11] Patent Number: 4,461,058

[45] Date of Patent: Jul. 24, 1984

[54] DRAWING FRAMES

[75] Inventor: Piero Gaudino, Cossato, Italy

[73] Assignee: Officine Gauding di P. Gaudino & C. S.a.s., Cossato, Italy

[21] Appl. No.: 377,273

[22] Filed: May 10, 1982

[30] Foreign Application Priority Data

May 20, 1981 [IT] Italy ..... 67679 A/81

[51] Int. Cl.[3] ..... D01H 5/22

[52] U.S. Cl. ..... 19/258; 19/261

[58] Field of Search ..... 19/258, 260, 261, 236

[56] References Cited

U.S. PATENT DOCUMENTS 1,554,987 9/1925 Butler ..... 19/260

1,782,549 11/1930 Stansfield et al. ..... 19/258

FOREIGN PATENT DOCUMENTS 340743 10/1959 Switzerland ..... 19/258

*Primary Examiner*—Louis Rimrodt

[57] ABSTRACT

A drawing frame with a drawing region or with two independent drawing regions includes, as a whole, four or more so-called drawing and control rollers. These latter all comprise pressure rollers with barrel rubbers. The control roller situated immediately upstream of the draw-off or "total" drawing roller is arranged in such a position that its periphery is separated from that of the drawing roller by a narrow gap. The ratios between the diameters and the speeds of rotation of these rollers is selected in such a way that the peripheral velocity of the "total" drawing roller is significantly greater than the peripheral velocity of the adjacent control roller. Consequently, an upwardly directed flow of air is created which removes the floating fibres which would otherwise tend to form windings or so-called "rolls".

1 Claim, 3 Drawing Figures

DRAWING FRAMES

The present invention relates to the field of spinning of wool, silk, cotton, bast fibres, man-made fibres, and all mixtures thereof, and has for its subject improvements in drawing frames having at least one drawing region for the direct spinning of combed and semi-combed yarn.

It is known that spinning machines provided with drawing frames are fed with slivers, that is, continuous bundles of fibres which extend parallel to one another, of suitable dimensions, coming from the second or third steps of preparation, or even from the finisher.

With these types of machines it is possible to carry out one or two independent drafts, with a total draft which may even attain 300 times and more, and it is possible to eliminate the steps of preparation before the spinning, with consequent reductions in the costs of the installation and labour.

To obtain a draft of the degree referred to above, the sliver of fibres must be controlled continuously, that is, guided and held together, because otherwise, even in the best case, a rather irregular yarn of little or no commercial value would be obtained.

Currently, the following two basic systems for controlling the sliver subjected to drawing are used in all spinning machines:

The system which controls the slivers upstream of the drawing rollers by means of a device including so-called upper and lower "cages" with associated endless belts.

The control system in which the upper belt passes over a "cage" and the lower one over a fixed transverse bridge.

In both cases, the lower belt advances because it is drawn by friction from the driven roller and carries the upper belt in rotation.

These belts are pressed together with a certain force and the sliver of fibres is made to pass or is drawn between them towards the drawing rollers or the so-called "draw-off roller" which, by rotating with a peripheral speed greater than that of the belts, effects the drawing or attenuation of the sliver of fibres.

The drawing system described so far, however, have some serious disadvantages. With the use of such systems, in fact, windings or so-called "rolls" of fibre form around the pressure roller of the draw-off roller, around the draw-off roller itself, and around the control belts, with consequent risks of breakage of the rollers, the "cages" and the belts.

This phenomenon occurs because of the fact that, during this very intense drawing, the fibres which are made to slide over one another become electrostatically charged, and in many cases break with consequent successive shortening and curling, to become transformed into fibres which float at the sides of the sliver and so forth, and by this encourage the formation of damaging windings.

The machine must therefore be subjected to a continuous and attentive supervision, and to very exacting and frequent maintenance with consequent considerable loss of production time.

The object of the present invention is to obviate the above-mentioned disadvantages caused by the formation of the windings or so-called "rolls" on the upper and lower drawing belts and on the draw-off roller.

According to the present invention, this object is achieved by providing a drawing frame having at least one drawing region, for the direct spinning of combed and semi-combed yarn on a spinning machine, which is characterised in that the control of the sliver of fibres is effected solely by the use of rollers in which the upper or pressure and control rollers are of the type having barrel rubbers and the control roller nearest the draw-off roller of the drawing frame is mounted in a position such that the periphery of the control roller is separated from that of the draw-off roller by a very small gap, and also in that the ratios between the diameters and the speeds of rotation of the said rollers are chosen in such a way that the peripheral velocity of the draw-off roller is significantly greater than the peripheral velocity of the last control roller.

In a preferred embodiment of the invention the value of the ratio between the peripheral velocity of the draw-off roller and the last control roller, respectively lies between 5 and 60.

In another preferred embodiment of the invention, the value of the ratio between the diameters of the draw-off roller and the last control roller is between 0.5 and 5.

In a further preffered embodiment of the invention, the width of the space between the peripheries of the said rollers is between 0.1 and 8 mm.

The presence of the above-specified characteristics in the drawing frame produce, by the effect of the greater peripheral velocity of the draw-off roller, an upwardly directed flow of air which removes the floating fibres which would otherwise tend to form windings or "rolls" on the rollers, particularly on the last control roller.

With the arrangement and dimensions of the parts described above, it is possible to obtain, by the direct spinning process, yarns of optimum quality in all aspects from the point of view of both technological and mechanical characteristics, whilst the wastage due to falling of the floating fibres is reduced and the necessity for maintenance and repairs is drastically reduced.

Other characteristics and advantages of the invention will become clearly apparent from the following description which refers, by way of non-limiting example, to a practical embodiment illustrated in the attached drawings, in which.

Figure 1:
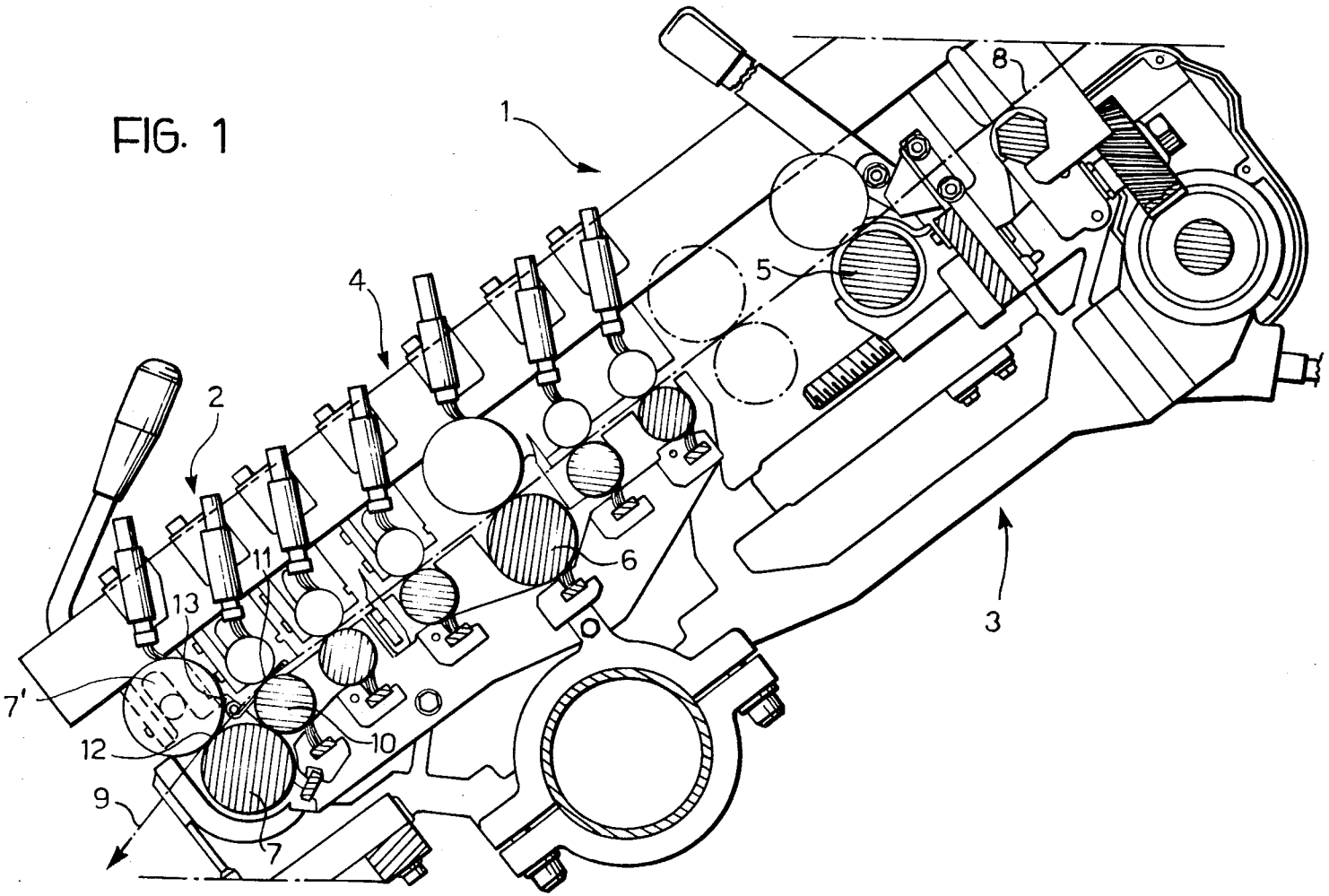
FIG. 1 is a schematic, partially-sectioned side view of a drawing frame according to the invention.
Figure 2:
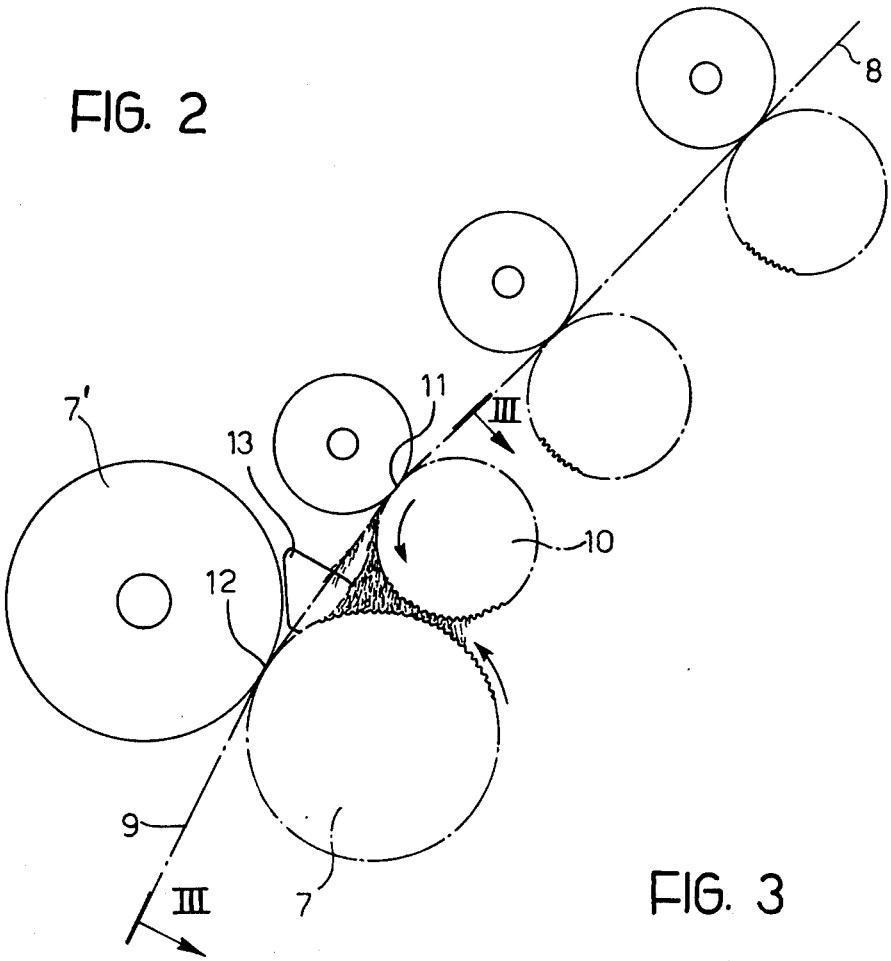
FIG. 2 is a schematic partial section of the drawing frame, shown on an enlarged scale.
Figure 3:
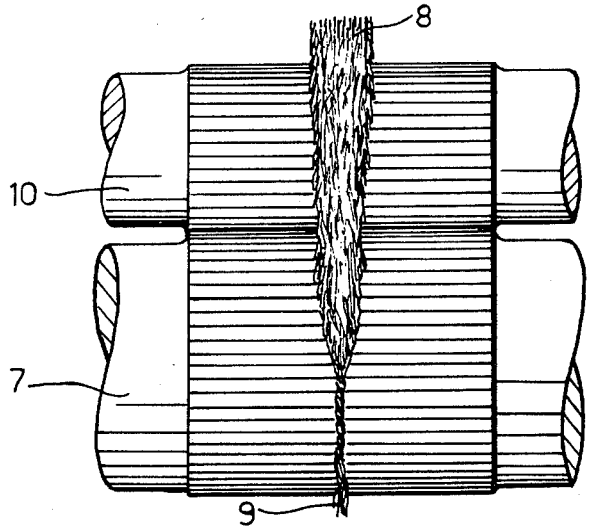
FIG. 3 is a section taken on the line III—III of FIG. 2.

In the drawings, there are shown (see FIG. 1) two independent drawing regions 1, 2, respectively, of a drawing frame for a spinning machine for performing the process of direct spinning of combed and semi-combed yarn.

The drawing rollers and the control rollers (not shown) are controlled in a known manner and are supported by a lower frame 3 mounted on the bed of a spinning machine (not shown). In their turn, the upper pressure rollers cooperating with the rollers are carried by a movable frame 4 which is located above the first frame and has the function of pressing the rollers supported thereby against the rollers mounted in the lower frame 3 with the desired pressure.

The upper or pressure rollers, which cooperate with the drawing rollers 5, 6, 7 respectively, have a covering of hard rubber. In their turn, the control rollers are of the type having barrel rubbers.

Reference numeral 8 indicates a sliver of fibres which enters the drawing frame, and reference numeral 9 indicates the yarn which, being twisted immediately after leaving the draw-off roller 7 and its associated pressure roller 7', constitutes the product of the transformation effected by the drawing and condensing action exerted on the sliver during its passage through the drawing frame.

The roller 10 situated immediately upstream of the draw-off (or so-called "total") roller 7 is arranged in such a way that its periphery virtually brushes that of the roller 7 (the "total" drawing roller). In fact, the space between the peripheries of these rollers 7, 10 can vary between 0.1 and 8 mm.

The ratio between the diameters of the rollers 7, 10 can vary between the values of 0.5 and 5, provided that the speeds of rotation of these rollers are such that the peripheral velocity of the roller 7 is between 5 and 60 times greater than that of the roller 10.

By virtue of the arrangements referred to above, and mainly because of the fact that the peripheral velocity of the roller 7 is significantly greater than that of the roller 10, an upwardly directed flow of air is created which removes the floating fibres which would otherwise tend to form windings.

In fact, the short, curled and electrically-charged floating fibres, which have the tendency to "clog up" the roller 10, are carried upwardly and kept in contact with the overlying bundle of fibres of the sliver 8 which is subjected, during its passage through the respective nip zones 11, 12, to a restriction due to the operation of a condenser 13. The floating fibres carried upwards and kept in contact with the sliver 8 converge towards the nip zone 12 and then emerge in the form of yarn 9 which is immediately twisted in a known manner.

The described operation of the drawing frame according to the invention takes place with the control of the fibres being effected by the rollers, the pressure rollers of which, having barrel rubbers, ensure the effective control of any type of fibre and, finally, a finished product of excellent quality.

Naturally, while the principle of the invention remains the same, its details can be widely varied from what has been described and illustrated purely by way of example, without by this departing from the scope of the present invention.

I claim:

1. A drawing frame for a spinning machine having at least one drawing region for slivers for direct spinning of combed and semi-combed yarn comprising a plurality of pressure and control rollers for the sole control of said slivers and a draw-off roller mounted in said frame adjacent one of said control rollers with the periphery of said control roller being separated from the periphery of said draw-off roller by a small gap, the improvement comprising the width of said gap being between 0.1 and 8 mm, wherein the ratio of the peripheral velocity of said draw-off roller to the peripheral velocity of said adjacent control roller is between 5 and 60, and the ratio of the diameter of the draw-off roller to the diameter of said adjacent control roller is between 0.5 and 5 to provide a flow of air between said draw-off roller and said adjacent control roller to prevent the formation of fibrous windings on said control roller.

* * * * *